United States Patent [19]

La Pomatière

[11] Patent Number: 4,858,657

[45] Date of Patent: Aug. 22, 1989

[54] YARN CUTTING DEVICE OF THE GRIPPER SHUTTLE TYPE

[76] Inventor: Aimé Fabre La Pomatière, Brangues, France

[21] Appl. No.: 162,961

[22] Filed: Mar. 2, 1988

[30] Foreign Application Priority Data

Mar. 13, 1987 [FR] France ..... 87 03701

[51] Int. Cl.[4] ..... D03D 47/24

[52] U.S. Cl. ..... 139/438; 139/302; 139/430; 139/450

[58] Field of Search ..... 139/429, 450, 430, 438, 139/439, 302, 196.2

[56] References Cited

U.S. PATENT DOCUMENTS

| | | | |
|---|---|---|---|
| 3,717,181 | 2/1973 | Fabre | 139/438 |
| 4,027,704 | 6/1977 | Romanin | 139/196.2 |
| 4,079,758 | 3/1978 | Conte | 139/438 |
| 4,553,570 | 11/1985 | Moessinger et al. | 139/435 |

FOREIGN PATENT DOCUMENTS

| | | |
|---|---|---|
| 7019664 | 12/1971 | France . |
| 7236808 | 5/1974 | France . |

*Primary Examiner*—Andrew M. Falik
*Attorney, Agent, or Firm*—Dowell & Dowell

[57] ABSTRACT

A yarn cutting device for weaving looms having fixed reserves of weft and which operate with a gripper type weft-carrying shuttle wherein the shuttle supports a guiding member which carries the yarn towards the shed on the side of the loom. The guiding member includes two metal plates mounted between two resilient shims which allow the plates to be forced apart to receive a blade moved vertically into the path of the guiding member as the shuttle enters the shed to thereby sever the yarn. In an alternate embodiment, the guiding member is fixed adjacent the shed and the blade is carried by the shuttle.

8 Claims, 4 Drawing Sheets

1
2
4
6
7
8
9
10
11
12
12a
12b
13
14
15
16
III
III 6
7
9
10
12
12a
12b
13
14
14a
16

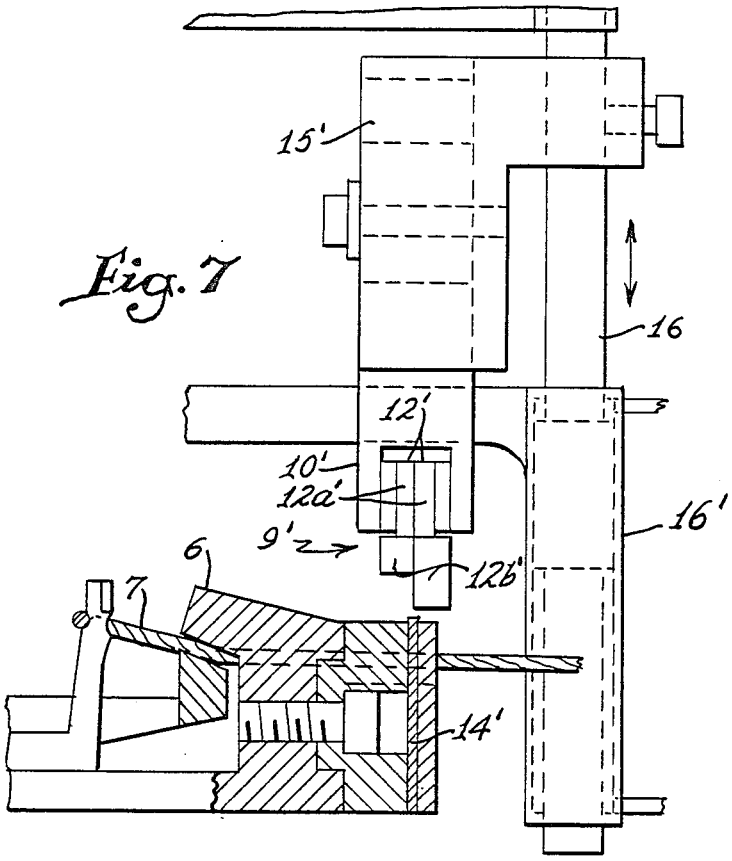
Fig. 7
Fig. 8
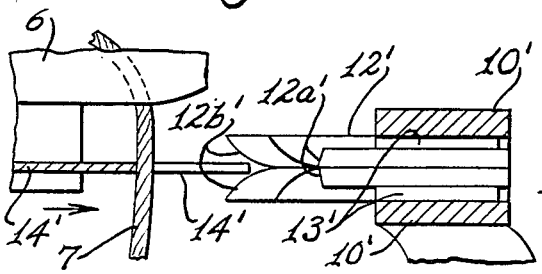
Fig. 9
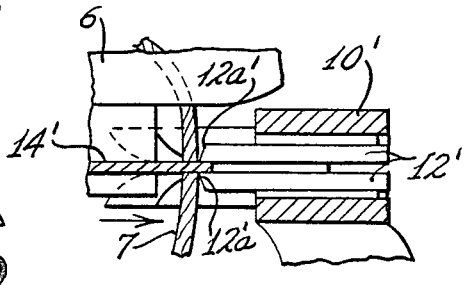
Fig. 10
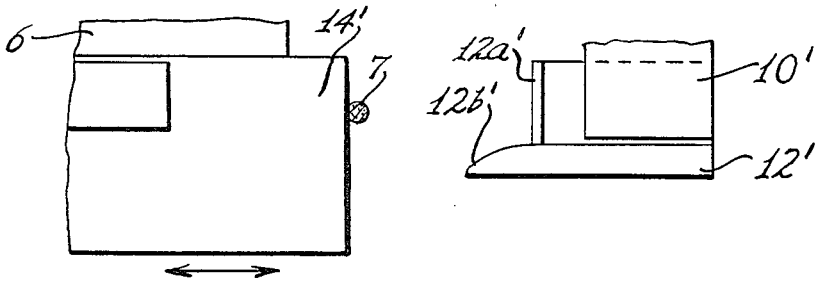

YARN CUTTING DEVICE OF THE GRIPPER SHUTTLE TYPE

BACKGROUND OF THE INVENTION

1. Field of the Invention

The present invention relates to weaving looms in which each pick is constituted by a length of yarn which is taken, by a thrown weft-carrying member or "false dummy shuttle", from one or the other of two fixed weft reserves provided laterally on the frame of the loom.

2. History of the Related Art

It is known that, in looms the aforementioned type, in order to ensure good functioning of the assembly and correct production of the selvedges of the fabric, the yarn corresponding to the penultimate pick must be cut immediately before the false shuttle enters in the shed, since it is this yarn which is taken up on the same side by the false shuttle in order to obtain a new pick. To that end, in conventional constructions, a fixed knife adapted to cut the yarn by simple contact is merely provided at one and the other of the ends of the gripping mechanism of the false shuttle.

Although such a cutting system functions satisfactorily when the yarns are of small or average diameter, this is no longer the case when the weft of the fabric to be produced is formed by yarns of large diameter or yarns made of a particularly severing resistant material (metal or glass).

SUMMARY OF THE INVENTION

It is an object of the present invention to overcome the drawbacks of the prior art by providing the false shuttle with an improved yarn-cutting device arranged so as to cut the yarn positively at the level of the conventional lateral grip.

The device according to the invention comprises, at least one cutting member and at least one guiding member which are either mounted on the weft-carrying member or false shuttle or laterally on either side of the loom. The guiding member is formed by two metal plates maintained elastically urged against each other so as to be able to move apart in order to allow passage for the cutting member. Further, means are provided for vertically displacing each of the members which are fixed laterally on the loom in order to bring the cutting member into the path of displacement of a member which is mounted on the false shuttle, when the shuttle enters the shed.

BRIEF DESCRIPTION OF THE DRAWINGS

The invention will be more readily understood on reading the following description with reference to the accompanying drawings, in which:

FIG. 7 is a partial cross sectional elevational view showing an alternate embodiment of the invention wherein the shuttle carries a blade which is moved toward a guiding member reciprocally mounted with respect to the loom frame.

FIGS. 8, 9 and 10 are plan views illustrating the movement of the shuttle with respect to the guiding member of the alternate embodiment shown in FIG. 7.

DESCRIPTION OF THE PREFERRED EMBODIMENT

Figures 1, 2:
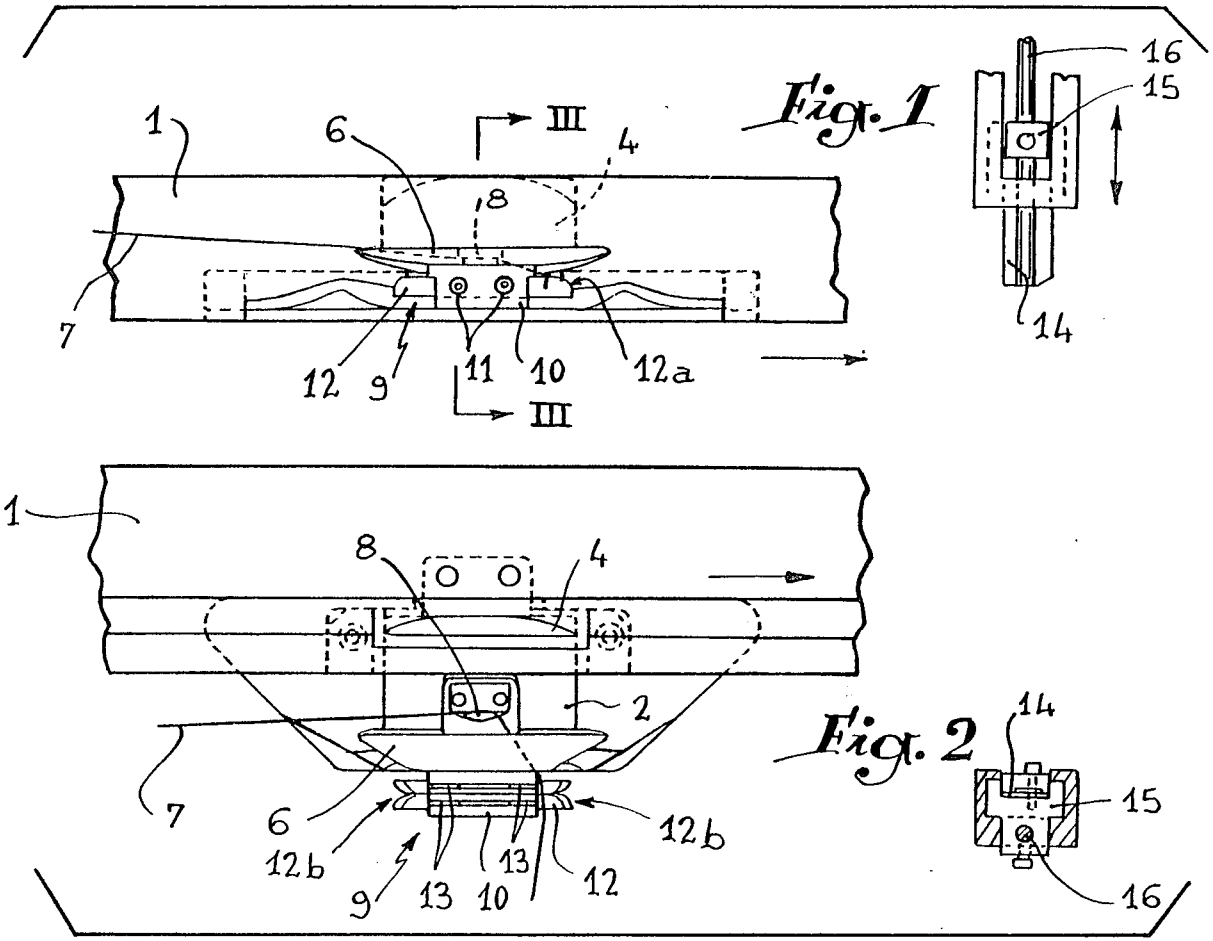
FIG. 1 is a front view of a yarn-cutting device according to the invention.
FIG. 2 is a plan view thereof from above, the support for guiding the mobile cutting blade being cut horizontally.

Referring now to the drawings, and firstly to FIGS. 1 and 2, reference 1 very schematically represents the general outline of a false shuttle of the type such as described in either of Applicants' French Patents Nos. 70 19664/2 087 725 and 72 36808/2 202 965, to which Patents reference may be usefully made for any further details concerning the arrangement of the thrown weft-carrying member or false or dummy shuttle, and the general functioning of the type of weaving loom L in question.

Figure 3:
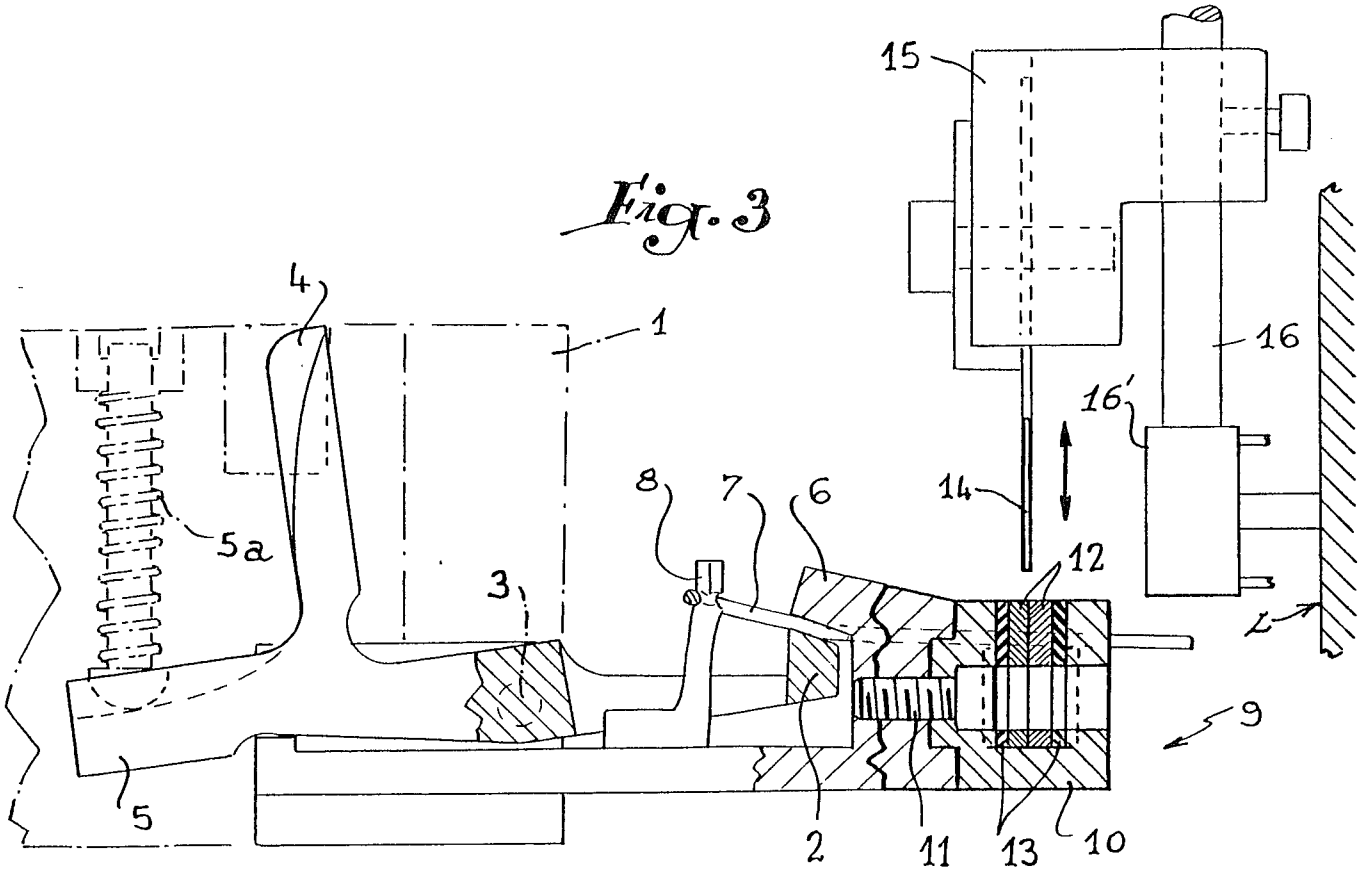
FIG. 3 is a partial transverse section on a larger scale, along plane III—III indicated in FIG. 1.

This false shuttle is conventionally equipped with a yarn presser grip mechanism, comprising a movable jaw 2 (FIG. 3) articulated longitudinally at 3 on the false shuttle. The jaw 2 is provided with an upper manoeuvring tab 4 and a heel 5 associated with a spring 5*a*. This spring elastically holds the movable jaw 2 against a fixed jaw 6, thus gripping the weft yarn 7 which extends laterally by a catch 8, which yarn is released only by action against the tab 4.

It will be observed that the jaws 2 and 6, like catch 8, are offset laterally on the side of the false shuttle 1 which faces opposite the comb of the loom. It is on the free side of the fixed jaw 6 their is mounted one of the members of the yarn-cutting device according to the invention.

In the embodiment described herein, a guiding member referenced 9 which comprises a box 10 of U-shaped cross section, is fixed laterally against the fixed jaw 6 in any appropriate manner, for example with the aid of screws such as 11. In this box 10 are housed two metal plates 12 which are resiliently urged against each other by means of shims 13 made of a deformable material (rubber or synthetic material). It will be noted that the plates 12, which project beyond the vertical edges of the box 9, are sectioned in the manner illustrated in FIG. 4, so as to comprise, on the one hand, an upper transverse sharp edge 12*a* for cutting, disposed at the level of each of the edges mentioned above, and, on the other hand, ends 12*b* with rounded section forming funnels.

The yarn-cutting device also comprises, on each of the two sides of the loom L, a cutting member formed by a blade 14 (FIG. 3) borne by a block 15 suitably guided and secured to a vertical rod 16 which is animated by a vertical reciprocating movement, so that the blade is disposed either in the path of the box 10 when the false shuttle 1 enters the shed on one or the other side of the loom, or above this path when the false shuttle leaves the shed. In order to displace each of the two rods 16, an electro-magnet or a pneumatic jack 16' may be used, borne by the selection and control device (not shown) associated with the grip of the false-shuttle, which device is itself mounted on the side of the comb of the loom.

Figures 4, 5, 6:
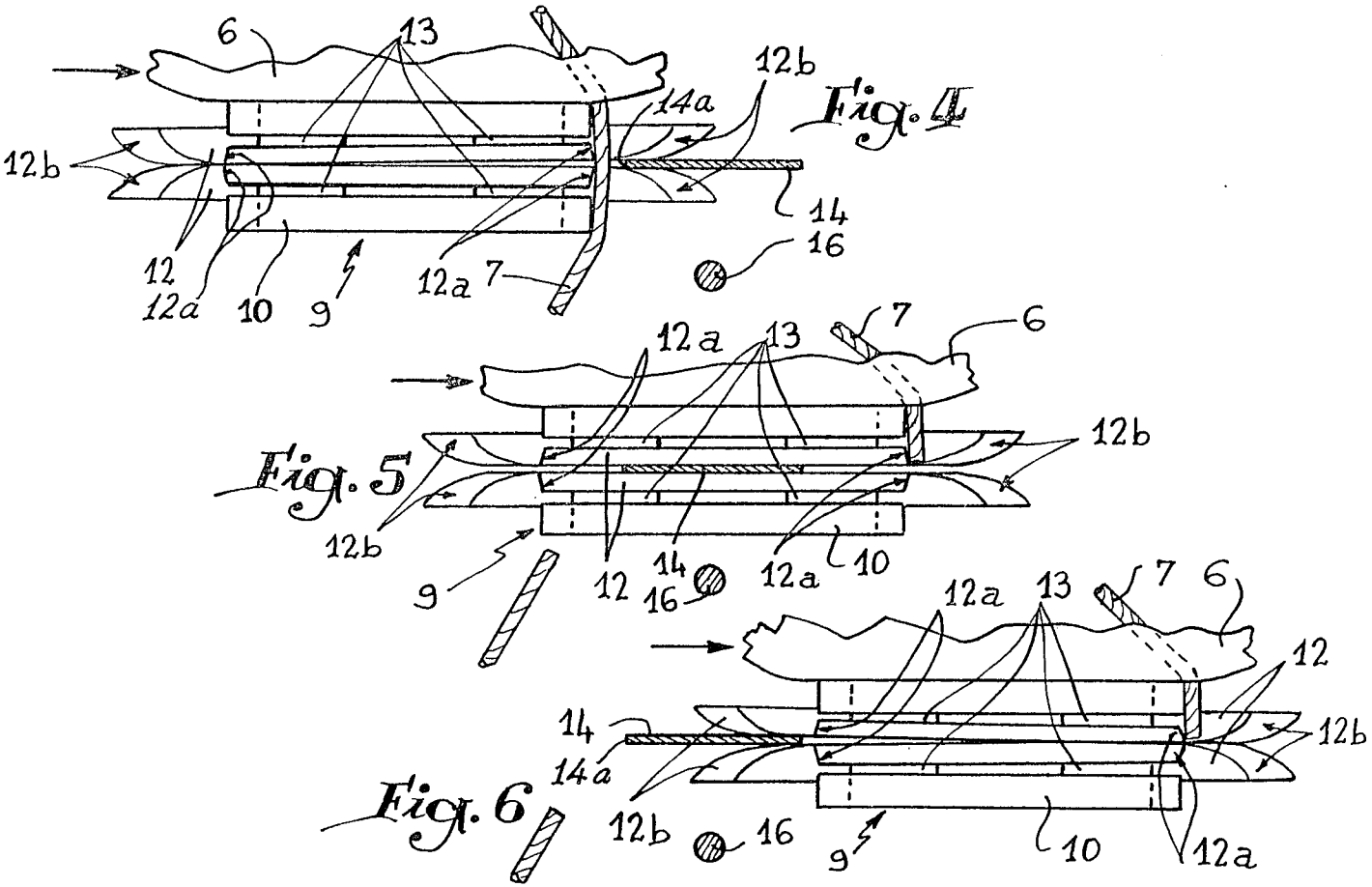
FIGS. 4, 5 and 6 are plan views illustrating the functioning of the device according to FIGS. 1 to 3.

The cutting edge 14*a* blade 14 faces the outside of the loom, so that, when the false shuttle 1 has taken and gripped the yarn of the penultimate pick (i.e. in fact the last pick which has emerged on the same side of the loom) and immediately before it enters the shed to deposit a fresh pick, the blade 14, lowered by rod 16, engages in the front funnel 12*b* of the plates 12 (FIG. 4). The plates move apart by momentary elastic deformation of the shims 13. The yarn 7 is then applied by blade 14 against the upper edge 12*a* and is consequently cut (FIG. 5), as if by scissors.

During displacement of the false shuttle 1, the plates 12 move apart progressively, allowing the blade 14 to leave the box 10 via the rear end thereof (FIG. 6), so that this blade can then rise under the effect of the upward return of the rod 16.

Tests have shown that the yarn-cutting device according to the invention cuts weft yarn whatever the diameter and strength thereof.

It will be readily appreciated that an equivalent result would be obtained by equipping the false shuttle laterally with a vertical blade 14' with two opposite cutting edges and by mounting on each of the two mobile rods 16 a guiding member 9' a described hereinabove, it being noted, however, that the plates 12' of such a member may comprise only one edge 12*a'* and only one section end 12*b'*.

with reference to FIGS. 7–10, such an equivalent arrangement is shown with respect to only one side of the loom, it being remembered that a similar arrangement would be provided along the opposite side of the loom. The block 10' supports a guiding member 9' which is mounted between resilient pads or shims 13'. The block 10' is carried by element 15' which is reciprocally raised and lowered by rods 16 operated by a piston 16' mounted to the loom frame. As the blade 14' approaches the ends 12*b'* of the plates 12', the plates separate allowing the blade to penetrate between the ends 12*a'* thereby cutting the yarn 7.

It must, moreover, be understood that the foregoing description has been given only by way of example and that it in no way limits the domain of the invention which would not be exceeded by replacing the details of execution described by any other equivalents.

What is claimed is:

1. A yarn cutting device in a weaving loom having a movable shuttle for carrying yarn comprising at least one cutting member and at least one guide member, reciprocating means for mounting one of said cutting member or said guide member to the loom so as to be selectively brought into general alignment with the shuttle, the other of said cutting member or said guide member being mounted to the shuttle so as to be carried thereby, said guide member including two plates which are normally urged into contact with one another by resilient means, said cutting member being aligned between said two plates, said plates being separable against said resilient means by said cutting member whereby the yarn is cut as said plates and said cutting member pass relative to one another.

2. The device of claim 1 wherein the guide member includes a generally U-shaped box, said two plates being mounted within said U-shaped box, and said resilient means including a pair of deformable shims mounted between said U-shaped box and said two plates.

3. The device of claim 1 wherein said plates have opposite end portions, at least one of said end portions having a cutting edge and having a tapered funnel portion extending outwardly with respect to said cutting edge.

4. The device of claim 1 wherein the cutting member is a vertically oriented blade having opposite ends, at least one of said ends being tapered to form a cutting edge.

5. The device of claim 1 including a single guide member, said single guide member being mounted to the shuttle, a pair of spaced reciprocating means, a cutting member carried by each of said reciprocating means whereby the yarn will be cut as the shuttle moves said single guide member into engagement with said two cutting members.

6. The device of claim 1 including a pair of spaced reciprocating means, a guide member mounted to each of said reciprocating means, and a cutting member mounted to the shuttle.

7. A yarn cutting device in a weaving loom having a movable shuttle for carrying yarn comprising a guide member mounted to the shuttle, said guide member including a U-shaped box having a pair of plates mounted therein, resilient means mounted within said U-shaped box for normally urging said plates into contact with one another, a cutting member, reciprocating means for mounting said cutting member so that said cutting member may be selectively aligned to pass between said plates, each of said plates having end portions, said end portions including a cutting edge and a tapered portion extending outwardly therefrom whereby the yarn is cut as said plates and said cutting member pass relative to one another.

8. A yarn cutting device in a weaving loom having a movable shuttle for carrying yarn comprising a cutting member mounted to the shuttle, a guide member, reciprocating means for mounting said guide member so as to be selectively aligned with said cutting member, said guide member including a housing, a pair of plates mounted within said housing, resilient means mounted within said housing for normally urging said plates into engagement with one another, said plates having opposite end portions, at least one of said end portions having a cutting edge and a tapered portion extending outwardly therefrom whereby the yarn is cut as said guide member and said cutting member pass relative to one another.

* * * * *